US012539451B2

(12) United States Patent
Yano et al.

(10) Patent No.: US 12,539,451 B2
(45) Date of Patent: Feb. 3, 2026

(54) GOLF CLUB HEAD

(71) Applicant: BRIDGESTONE SPORTS CO., LTD., Tokyo (JP)

(72) Inventors: Takeyuki Yano, Tokyo (JP); Wataru Ban, Tokyo (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 163 days.

(21) Appl. No.: 18/509,863

(22) Filed: Nov. 15, 2023

(65) Prior Publication Data

US 2024/0207698 A1 Jun. 27, 2024

(30) Foreign Application Priority Data

Dec. 22, 2022 (JP) ..... 2022-205559

(51) Int. Cl.
*A63B 53/06* (2015.01)
*A63B 53/04* (2015.01)

(52) U.S. Cl.
CPC ..... *A63B 53/0466* (2013.01); *A63B 53/0408* (2020.08); *A63B 53/0433* (2020.08); *A63B 53/0437* (2020.08); *A63B 53/06* (2013.01)

(58) Field of Classification Search
CPC ..... A63B 53/0466; A63B 53/0437; A63B 53/0433
See application file for complete search history.

(56) References Cited

U.S. PATENT DOCUMENTS

| | | | | |
|---|---|---|---|---|
| 2011/0207552 | A1 | 8/2011 | Finn et al. | |
| 2015/0360099 | A1 | 12/2015 | Ban et al. | |
| 2017/0014691 | A1 | 1/2017 | Takechi | |
| 2019/0255393 | A1 | 8/2019 | Mizutani | |
| 2020/0188743 | A1* | 6/2020 | Kitagawa | A63B 53/06 |

FOREIGN PATENT DOCUMENTS

| | | | |
|---|---|---|---|
| JP | 2007-275547 | * 10/2007 | A63B 53/0437 |
| JP | 2013-520229 | 6/2013 | |
| JP | 2016-002136 | 1/2016 | |
| JP | 2017-023216 | 2/2017 | |
| JP | 2019-141225 | 8/2019 | |

* cited by examiner

*Primary Examiner* — Raeann Gorden
(74) *Attorney, Agent, or Firm* — IPUSA, PLLC

(57) ABSTRACT

A golf club head includes a body; a face; and a crown. The body includes a crown opening; a beam dividing the crown opening; and a sole. The face includes a front surface that strikes a ball; and a back surface. The crown closes the crown opening. The sole has a butting structure that contacts the back surface of the face at a contact portion. As viewed in a crown-sole direction, a length from a face toe end to a face heel end in a toe-heel direction is set as a face length, and each of a toe edge and a heel edge of the beam and the contact portion is arranged within a 15% range of the face length in the toe-heel direction from an imaginary straight line extending in a face-back direction and through a center of the face length.

9 Claims, 6 Drawing Sheets

GOLF CLUB HEAD

CROSS-REFERENCE TO RELATED APPLICATIONS

This application is based upon and claims priority to Japanese Patent Application No. 2022-205559 filed on Dec. 22, 2022, the entire contents of which are incorporated herein by reference.

BACKGROUND OF THE INVENTION

1. Field of the Invention

The present invention relates to a golf club head.

2. Description of the Related Art

Conventionally, in a wood-type golf club head, it has been proposed to provide a butting structure in contact with the back surface of the face portion, for example, in order to reinforce the face portion and adjust the rigidity distribution and the like. On the other hand, a golf club head having an opening in the body portion and a carbon crown portion attached to the opening portion has also been proposed.

In such a golf club head, it is not easy to achieve both the improvement of the hitting sound and the hitting feeling and the increase of the launch angle of the ball when striking the ball.

RELATED-ART DOCUMENTS

Patent Documents

Patent Document 1: Japanese Patent Application Publication No. 2016-002136

Patent Document 2: Japanese Patent Application Publication No. 2017-023216

Patent Document 3: Japanese National Publication of International Patent Application No. 2013-520229

Patent Document 4: Japanese Patent Application Publication No. 2007-275547

Patent Document 5: Japanese Patent Application Publication No. 2019-141225

SUMMARY OF THE INVENTION

A golf club head according to an aspect of the present disclosure includes a body portion; a face portion; and a crown portion. The body portion includes a crown opening portion; a beam portion that divides the crown opening portion; and a sole portion. The face portion includes a front surface configured to strike a ball; and a back surface positioned on an opposite side of the front surface. The crown portion is attached to the body portion so as to close the crown opening portion. The sole portion has a butting structure that contacts the back surface of the face portion. As viewed in a crown-sole direction, a length from a face toe end to a face heel end of the face portion in a toe-heel direction is set as a face length, and each of a toe edge and a heel edge of the beam portion and a contact portion between the butting structure and the back surface is arranged within a 15% range of the face length in the toe-heel direction from an imaginary straight line extending in a face-back direction and through a center of the face length.

DETAILED DESCRIPTION OF EMBODIMENTS

Figure 1:
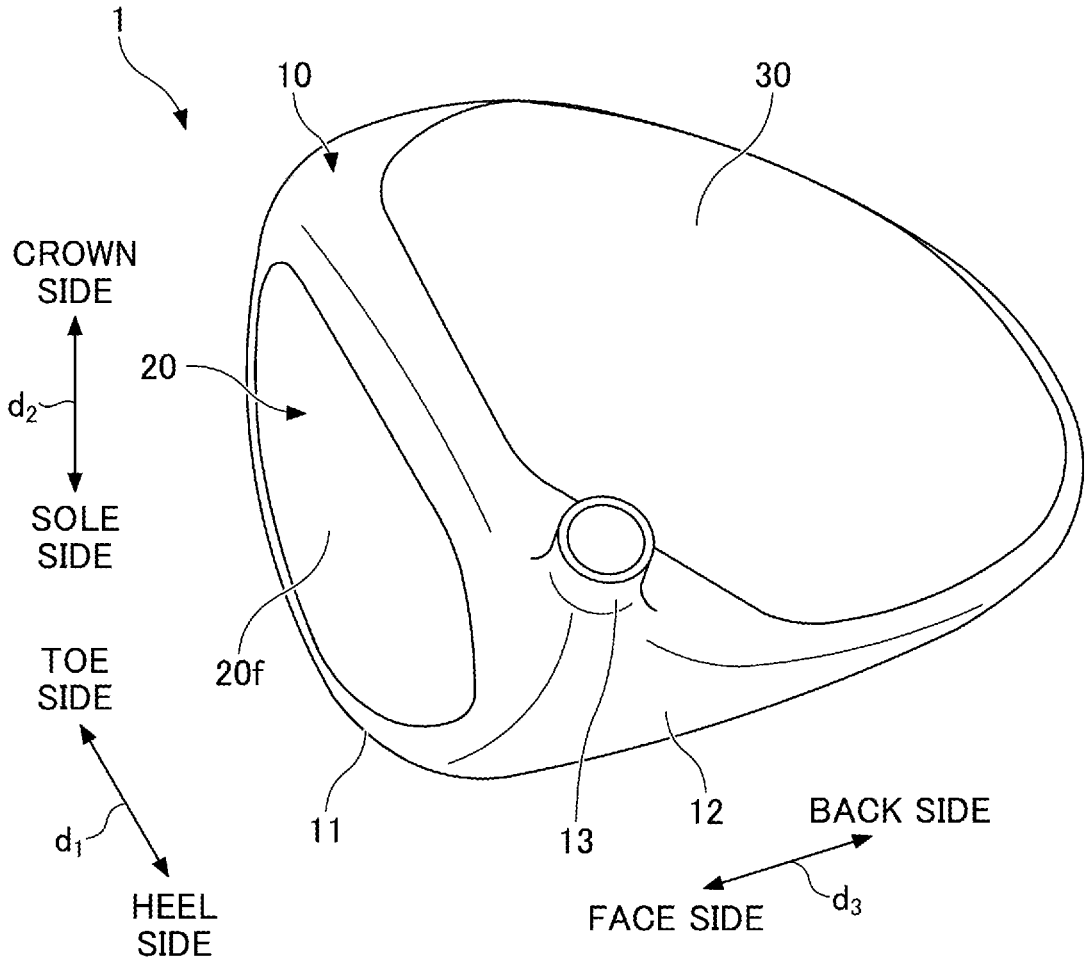
FIG. 1 is a perspective view illustrating an example of a golf club head according to a first embodiment of the present invention.

The present disclosure aims to improve the hitting sound and the hitting feeling of a golf club head, and to increase the launch angle of a ball when striking the ball.

According to the disclosed technique, it is possible to improve the hitting sound and the hitting feeling of the golf club head and to increase the launch angle of the ball when striking the ball.

Hereinafter, the embodiment will be described with reference to the drawings. In the drawings, the same elements are assigned the same reference numerals, and duplicate descriptions may be omitted.

First Embodiment

Figure 2:
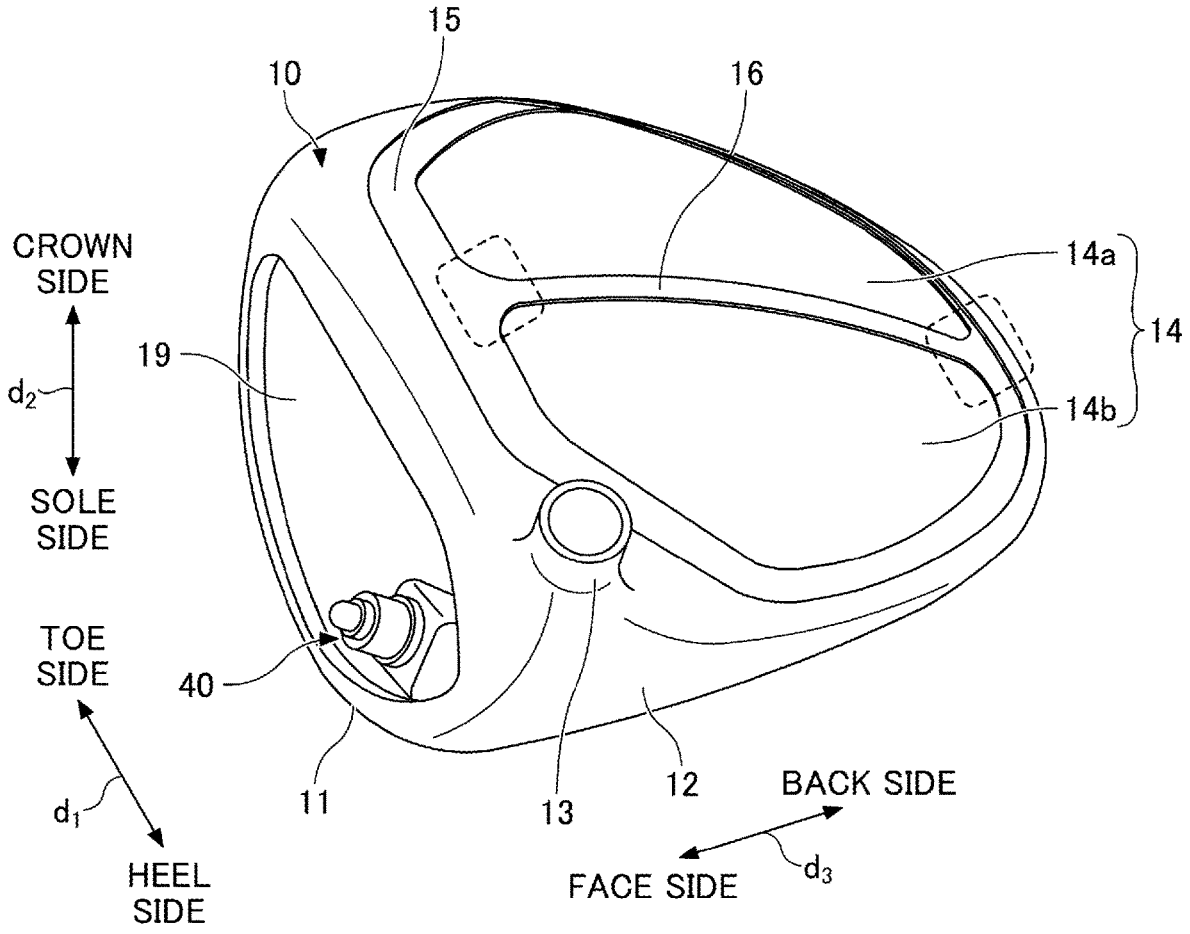
FIG. 2 is a perspective view illustrating an example of a body portion of the golf club head according to the first embodiment of the present invention.

FIG. 1 is a perspective view illustrating an example of a golf club head 1 according to the first embodiment. FIG. 2 is a perspective view illustrating an example of a body portion 10 of the golf club head 1 according to the first embodiment. In FIGS. 1 and 2, an arrow $d_1$ indicates the toe-heel direction (horizontal direction), an arrow $d_2$ indicates the crown-sole direction (vertical direction), and an arrow $d_3$ indicates the face-back direction (front-back direction). In the subsequent figures, similar directions may be illustrated if necessary.

The crown-sole direction is the vertical direction when the golf club head 1 is placed on a horizontal plane according to a specified lie angle and a specified loft angle. The crown-sole direction has a relationship approximately at right angles with the toe-heel direction and the face-back direction. Further, the toe-heel direction and the face-back direction have a relationship approximately at right angles.

The golf club head 1 illustrated in FIGS. 1 and 2 is a wood-type golf club head, such as that of a driver, but may be a utility head or a fairway wood head. The golf club head 1 has the body portion 10, a face portion 20, and a crown portion 30. More specifically, the golf club head 1 has a hollow structure in which the face portion 20 and the crown portion 30 are joined to the body portion 10 and integrated. The surface on the inside of the hollow structure may be referred to as the inner surface and the surface on the outside of the hollow structure may be referred to as the outer surface.

The body portion 10 includes a sole portion 11, a side portion 12, and a hosel 13. The sole portion 11 forms the bottom of the golf club head 1. The side portion 12 is located between the crown portion 30 and the sole portion 11. The hosel 13 is a portion where a sleeve connected to the shaft is accommodated.

The body portion 10 further includes a face opening portion 19 that is open on the face side, and the face portion 20 is joined so as to close the face opening portion 19. The face portion 20 includes a face surface 20*f* (front surface) serving as a striking surface for striking a ball. The face portion 20 has a predetermined thickness, and the face surface 20*f* forms an outer surface of the face portion 20.

The body portion 10 and the face portion 20 can be formed by using, for example, titanium, titanium alloy, stainless steel, aluminum, aluminum alloy, iron-based metal, magnesium, magnesium alloy, or the like. The body portion 10 and the face portion 20 may be formed by using fiber-reinforced resin. The body portion 10 and the face portion 20 may be formed of the same material or different materials.

The fiber-reinforced resin is a composite material of a fiber serving as a reinforcing member and a resin. The fibers constituting the fiber-reinforced resin include, for example, carbon fibers, glass fibers, aramid fibers, polyethylene fibers, Zylon fibers, boron fibers, and the like. The resins constituting the fiber-reinforced resin include, for example, epoxy resins, phenolic resins, polyester resins, polycarbonate resins, and the like.

The body portion 10 further includes a crown opening portion 14 that is open on the opposite side from the sole portion 11, and a crown attachment portion 15 is provided around the crown opening portion 14 when viewed in the crown-sole direction. The crown attachment portion 15 is an annular step portion that is one step lower than the surface of the body portion 10, and the crown portion 30 can be positioned by the crown attachment portion 15.

The body portion 10 further includes a beam portion 16. The beam portion 16 is provided so as to bridge the face side and the back side of the crown attachment portion 15. There is no step difference between the upper surface of the beam portion 16 and the upper surface of the crown attachment portion 15. The beam portion 16 divides, for example, the crown opening portion 14 into a first opening portion 14*a* located further towards the toe side relative to the beam portion 16 and a second opening portion 14*b* located further towards the heel side relative to the beam portion 16. The crown attachment portion 15 and the beam portion 16 can be integrally formed with portions of the body portion 10 other than the crown attachment portion 15 and the beam portion 16.

As illustrated by the dashed line in FIG. 2, the connection portions, between both ends of the beam portion 16 in the longitudinal direction and the crown attachment portion 15, become wider as the connection portions approach the crown attachment portion 15 as viewed in the crown-sole direction. Such a configuration can prevent the concentration of stress, and can provide an effect of maintaining the strength of the beam structure. The width of the beam portion 16 in the toe-heel direction is, for example, constant, except for the two connection portions that are widened.

The longitudinal direction of the beam portion 16 may be parallel to the face-back direction or inclined with respect to the face-back direction. In order to enhance the rigidity of the body portion 10, the longitudinal direction of the beam portion 16 is preferably close to being parallel to the face-back direction.

The width of the beam portion 16 in the toe-heel direction is, for example, greater than or equal to 4 mm and less than or equal to 10 mm. The thickness of the beam portion 16 in the crown-sole direction is, for example, greater than or equal to 0.5 mm and less than or equal to 2 mm. The thickness of the beam portion 16 in the crown-sole direction here refers to the thickness of the portion other than a thin portion 16*a* when the beam portion 16 includes the thin portion 16*a* described later. The length of the beam portion 16 in the face-back direction is, for example, greater than or equal to 60 mm and less than or equal to 90 mm. By making the beam portion 16 in such a dimensional range, the rigidity of the entire golf club head 1 can be increased without increasing the weight of the golf club head 1 more than necessary.

The crown portion 30 forms an upper part of the golf club head 1. The crown portion 30 is formed of, for example, a fiber-reinforced resin. As a result, the weight of the crown portion 30 can be reduced compared to the case where the crown portion is formed of metal, and therefore, surplus weight can be generated, and the surplus weight can be distributed to an optimum position of the golf club head 1.

The crown portion 30 is attached to the crown attachment portion 15 and the beam portion 16 of the body portion 10 so as to close the crown opening portion 14. The crown portion 30 is attached, for example, to the entire upper surface (the surface on the crown portion 30 side) of the beam portion 16 and the crown attachment portion 15 provided around the crown opening portion 14 by an adhesive. The width of the beam portion 16 in the toe-heel direction is preferably larger than the thickness in the crown-sole direction. In this way, the area of the upper surface of the beam portion 16 can be increased without changing the weight of the beam portion 16, so that the bonding area between the crown portion 30 and the beam portion 16 can be increased, and the bonding strength between the body portion 10 and the crown portion 30 can be improved.

Further, by improving the bonding strength between the body portion 10 and the crown portion 30, when the deflection of the crown portion 30 becomes large, the risk of cracking or peeling occurring in the crown portion 30 due to insufficient strength can be reduced. In particular, it is effective when the crown portion 30 is formed by using fiber-reinforced resin instead of metal. By joining the crown portion 30 to both the crown attachment portion 15 and the beam portion 16, the stress applied to the crown portion 30 is not concentrated in the crown attachment portion 15, but is also applied to the beam portion 16, so that the stress can be distributed. Thus, the risk of cracking occurring in the crown portion 30 can be reduced.

Figure 3:
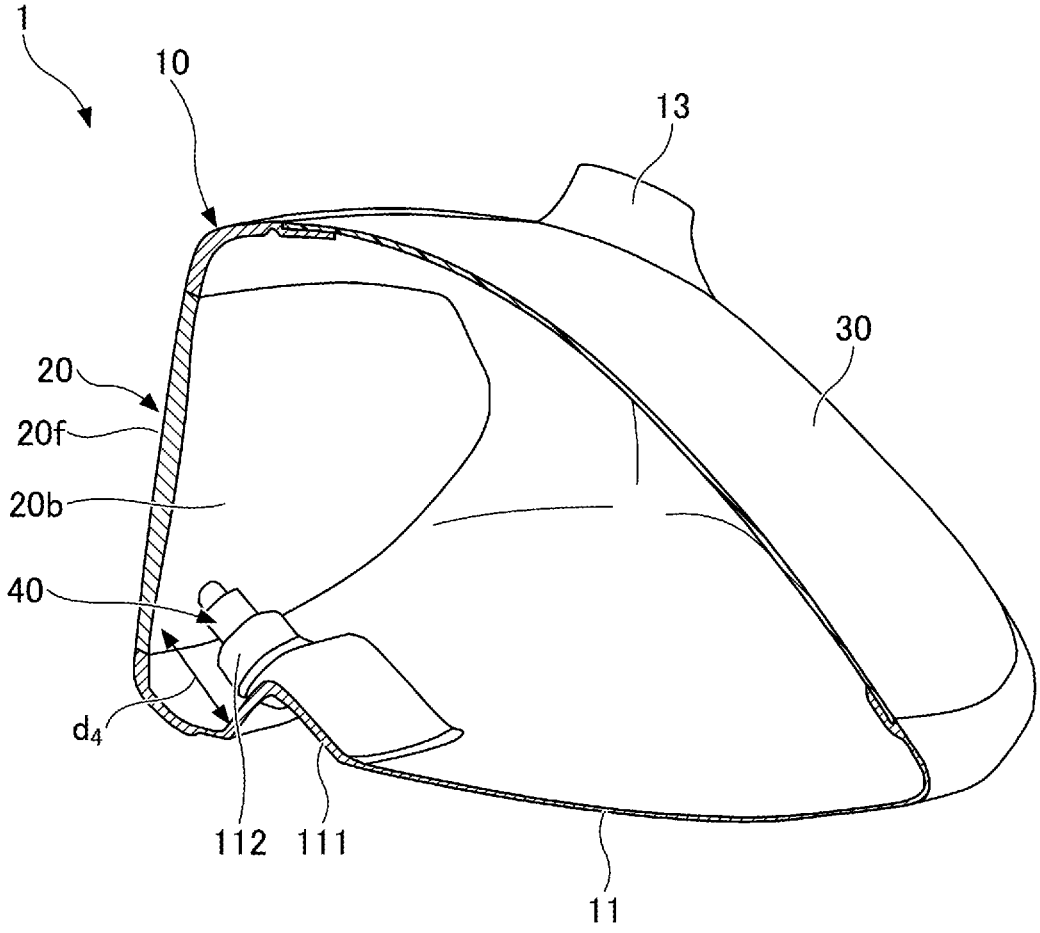
FIG. 3 is a cross-sectional view (part 1) illustrating an example of the golf club head according to the first embodiment of the present invention.
Figure 4:
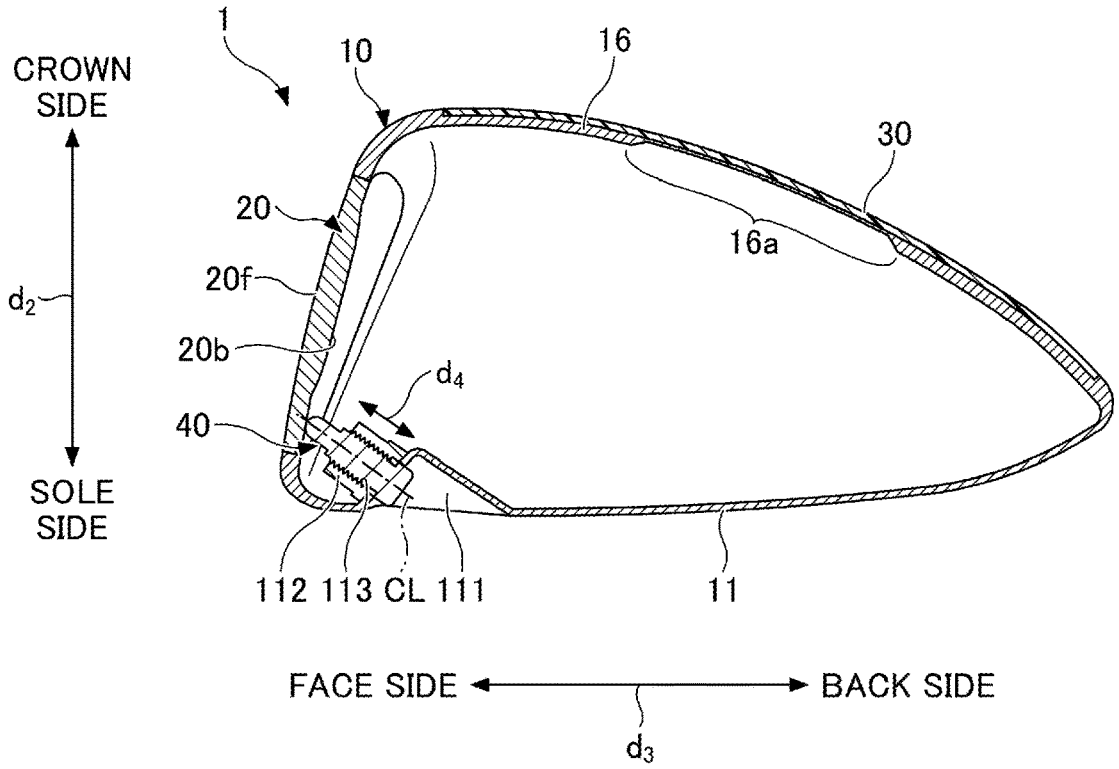
FIG. 4 is a cross-sectional view (part 2) illustrating an example of the golf club head according to the first embodiment of the present invention.

FIGS. 3 and 4 are cross-sectional views illustrating an example of the golf club head 1 according to the first embodiment. The butting structure will be described with reference to FIGS. 3 and 4 in addition to FIGS. 1 and 2.

As illustrated in FIGS. 1 to 4, the sole portion 11 has a butting structure 40 in contact with the back surface 20*b* of the face portion 20. More specifically, the sole portion 11 is provided with a recess portion 111 recessed toward the inside of the hollow structure, and a fixing portion 112 is formed in the wall portion of the recess portion 111 on the face portion 20 side. Note that a back surface 20*b* is located on the opposite side of the face surface 20*f*, in the face portion 20.

The fixing portion 112 is provided at a position separated from the face portion 20 in the $d_3$ direction. The fixing portion 112 has a cylindrical shape and is provided with the center axis oriented in the $d_4$ direction. A female screw portion 113 is formed on the inner wall surface of the fixing portion 112. The fixing portion 112 is an attachment portion for fixing the butting structure 40 to the body portion 10.

The butting structure 40 is a shaft member extending in the $d_4$ direction toward the back surface 20*b* side of the face portion 20, and the tip portion contacts the back surface 20*b* of the face portion 20. The central axis CL of the butting structure 40 is parallel to the $d_4$ direction. Note that the $d_4$ direction is directed obliquely upward from the back side in the $d_3$ direction toward the face portion 20.

Figure 5:
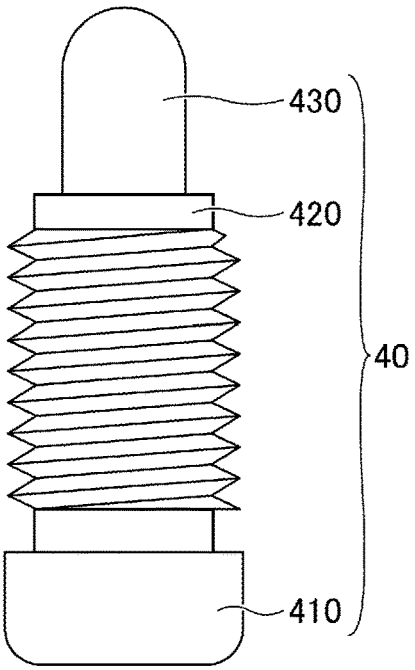
FIG. 5 is a view for explaining a butting structure according to the first embodiment of the present invention.

FIG. 5 is a diagram for explaining the butting structure. Referring to FIG. 5 in addition to FIGS. 1 to 4, the butting structure 40 has a head portion 410, a cylindrical portion 420, and a tip portion 430. The cylindrical portion 420 is provided on one side of the head portion 410 concentrically with the head portion 410. The tip portion 430 is provided on one side of the cylindrical portion 420 concentrically with the head portion 410 and the cylindrical portion 420. The cylindrical portion 420 is provided with a male screw portion on a part of the side surface.

The tip portion 430 has a shape in which the cross-sectional area (the cross-sectional area in the direction perpendicular to the central axis CL) gradually decreases as the area is further away from the cylindrical portion 420 along the central axis CL (see FIG. 4), for example, and has a curved surface. The tip portion 430 is, for example, hemispherical.

As the material of the head portion 410, the cylindrical portion 420, and the tip portion 430, for example, metal members such as titanium, titanium alloy, aluminum, aluminum alloy, tungsten, tungsten alloy, stainless steel, iron-based metal and the like can be used. The above-mentioned metal members may be used as the material of the head portion 410 and the cylindrical portion 420 for shock mitigation when striking a ball, and non-metal members such as resin, rubber, FRP and the like may be used as the material of the tip portion 430, or the tip portion 430 may also be formed of the above-mentioned metal similar to the head portion 410 and the cylindrical portion 420, and the tip portion 430 may come into contact with the cylindrical portion 420 through a non-metal member.

The head portion 410 is provided with a hexagonal groove, for example. The butting structure 40 is rotated by inserting the tip portion of a hexagonal wrench or the like into the groove of the head portion 410, and the male screw portion of the cylindrical portion 420 can be screwed into the female screw portion 113 of the fixing portion 112.

The butting structure 40 can adjust the fixing position in the direction (the $d_4$ direction) from the fixing portion 112 towards the face portion 20. That is, the position of fixing the butting structure 40 to the fixing portion 112 changes along the $d_4$ direction according to the amount of screwing when the cylindrical portion 420 is screwed to the fixing portion 112. Thus, the extension length (amount of protrusion) of the butting structure 40 from the end face of the fixing portion 112 on the face portion 20 side towards the face portion 20 can be adjusted. That is, the position of the tip portion 430 in the $d_4$ direction can be adjusted.

Even if the butting structure 40 and the fixing portion 112 have individual variations, the tip portion 430 of the butting structure 40 can be surely brought into contact with the back surface 20*b* of the face portion 20 by adjusting the amount of screwing when the cylindrical portion 420 is screwed into the fixing portion 112. In the butting structure 40, the fixing position where the extension length from the fixing portion 112 is maximum, is the position where the head portion 410 comes into contact with the end face of the back side of the fixing portion 112.

Preferably, the butting structure 40 is fastened to the sole portion 11 by screwing and bonding from the outer surface of the sole portion 11. By performing the screw fastening together with the bonding, the adjustment of the screwing amount of the butting structure 40 can be prevented from being deviated with changes over time.

In the present embodiment, the position of the fixing portion 112 in the $d_1$ direction is the center portion, but the fixing portion 112 may be located on the toe side or on the heel side. In the present embodiment, there is one set of the fixing portion 112 and the butting structure 40, but there may be two or more sets.

The fixing structure of the fixing portion 112 and the butting structure 40 is not limited to a screw structure, but may be another fixing structure such as press-fitting, bonding, welding, caulking, etc.

Figure 6:
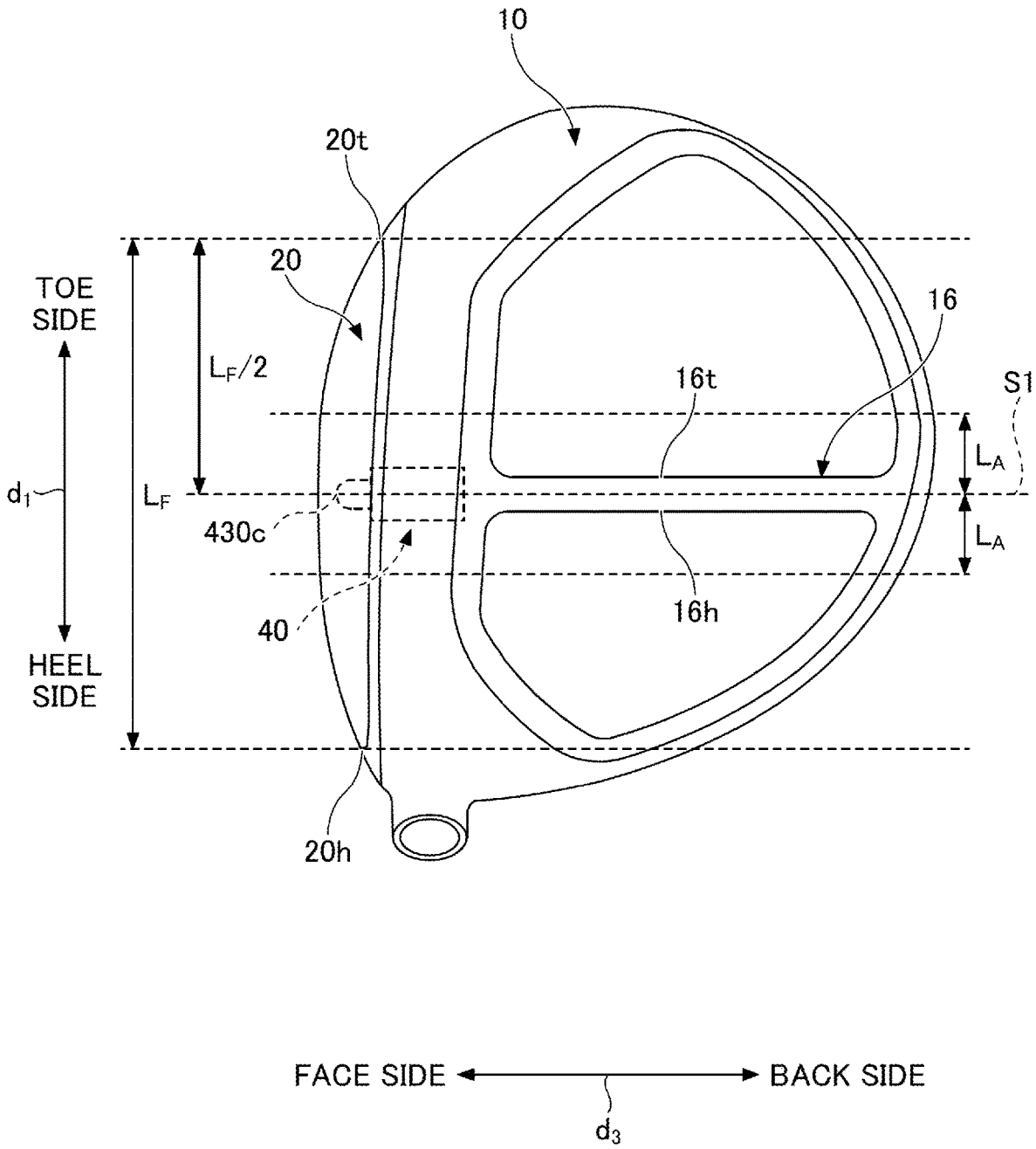
FIG. 6 is a top view (no. 1) illustrating an example of the golf club head according to the first embodiment of the present invention.

FIG. 6 is a top view (no. 1) illustrating an example of the golf club head 1 according to the first embodiment. FIG. 6 illustrates a state in which the crown portion 30 is not attached to the body portion 10.

In FIG. 6, $L_F$ denotes a face length. The notation of $L_F/2$ indicates half of the face length. Further, 20*t* denotes a face toe end which is a toe side end in the toe-heel direction of the face portion 20. Further, 20*h* denotes a face heel end which is a heel side end in the toe-heel direction of the face portion 20. The face length $L_F$ is a length in the toe-heel direction from the face toe end 20*t* to the face heel end 20*h* as viewed in the crown-sole direction.

Further, 16*t* denotes an edge of the beam portion 16 on the toe side in the toe-heel direction as viewed in the crown-sole direction in an area excluding the connection portion of the beam portion 16 with the crown attachment portion 15. Further, 16*h* denotes an edge of the beam portion 16 on the heel side in the toe-heel direction as viewed in the crown-sole direction in an area excluding the connection part of the beam portion 16 with the crown attachment portion 15. When the beam portion 16 is parallel to the face-back direction, the toe edge 16*t* and the heel edge 16*h* of the beam portion 16 may be lines instead of points.

The reference numeral 430*c* denotes a contact portion between the butting structure 40 and the back surface 20*b* of the face portion 20. That is, the contact portion 430*c* is the leading end of the tip portion 430 illustrated in FIG. 5. The contact portion 430*c* may contact the back surface 20*b* at a point or at a surface. The notation of S1 denotes an imaginary straight line extending in the face-back direction through the center of the face length $L_F$.

As illustrated in FIG. 6, each of the toe edge 16*t* and the heel edge 16*h* of the beam portion 16 and the contact portion 430*c* between the butting structure 40 and the back surface 20*b* is arranged within the $L_A$ range of the face length $L_F$ in the toe-heel direction from the imaginary straight line S1. Here, the $L_A$ is 15%. That is, $L_A=0.15\times L_F$.

As described above, in the golf club head 1, the beam portion 16 and the butting structure 40 are provided in the body portion 10, and each of the toe edge 16*t* and the heel edge 16*h* of the beam portion 16 and the contact portion 430*c* is arranged within the 15% range of the face length $L_F$ in the toe-heel direction from the imaginary straight line S1.

In general, if the crown opening portion 14 is provided, the rigidity of the entire crown portion may be reduced, and the comfortable metallic hitting sound and the hitting feeling may be impaired. However, in the golf club head 1, by providing the beam portion 16 in the body portion 10 and arranging each of the toe edge 16*t* and the heel edge 16*h* of the beam portion 16 in the above-mentioned range, the rigidity of the entire crown portion can be increased, and thus the hitting sound and the hitting feeling can be improved.

Further, in general, if the beam portion 16 is provided in the body portion 10, the rigidity of the golf club head 1 on the crown portion 30 side becomes too high, and there is a risk that the launch angle of the ball is lowered. However, in the golf club head 1, by providing the butting structure 40 in the body portion 10 and arranging the contact portion 430*c* in the above range, the deformation of the lower part of the face portion 20 is prevented more than that of the upper part, so that the launch angle of the ball when striking the ball can be increased. That is, in the golf club head 1, it is possible to both improve the hitting sound and the hitting feeling and increase the launch angle of the ball when striking the ball.

It is more preferable that each of the toe edge 16*t* and the heel edge 16*h* of the beam portion 16 and the contact portion 430*c* is arranged within the 10% range of the face length $L_F$ in the toe-heel direction from the imaginary straight line S1. Accordingly, it is possible to achieve both the further improvement of the hitting sound and the hitting feeling of the golf club head 1 and the further increase of the launch angle of the ball when striking the ball.

As viewed in the crown-sole direction, the contact portion 430*c* is preferably arranged within a range sandwiched between imaginary straight lines extending from the toe edge 16*t* and from the heel edge 16*h* of the beam portion 16. As viewed in the crown-sole direction, the imaginary straight line extending in the face-back direction through the contact portion 430*c* is preferably disposed between the toe edge 16*t* and the heel edge 16*h* of the beam portion 16. Accordingly, it is possible to achieve both the further improvement of the hitting sound and the hitting feeling in the golf club head 1 and the further increase of the launch angle of the ball when striking the ball.

Depending on the required performance of the golf club head 1, the toe edge 16*t* and the heel edge 16*h* of the beam portion 16 and the contact portion 430*c* may be arranged on the toe side of the imaginary straight line S1, further towards the toe side relative to the $L_A$ range. In this case, a golf club head that makes it easy to hit a draw ball can be achieved.

Further, depending on the required performance of the golf club head 1, the toe edge 16*t* and the heel edge 16*h* of the beam portion 16 and the contact portion 430*c* may be arranged on the heel side of the imaginary straight line S1, further towards the heel side relative to the $L_A$ range. In this case, a golf club head that makes it easy to hit a fade ball can be achieved.

As illustrated in FIG. 4, the beam portion 16 is preferably provided with the thin portion 16*a* that is recessed from the side facing the sole portion 11 to the side facing the crown portion 30. The beam portion 16 can be reduced in weight by providing the thin portion 16*a* in the beam portion 16, and, therefore, the beam portion 16 does not greatly inhibit the deflection of the crown portion 30. Further, because the thin portion 16*a* has a structure that is recessed from the side facing the sole portion 11 to the side facing the crown portion 30, the upper surface of the beam portion 16 is a flat plane and/or a curved surface without any recesses. Therefore, the entire upper surface of the beam portion 16 can be used for bonding with the crown portion 30, so that the bonding area with the crown portion 30 can be sufficiently secured. As a result, peeling of the crown portion 30 due to insufficient bonding strength can be prevented.

Figure 7:
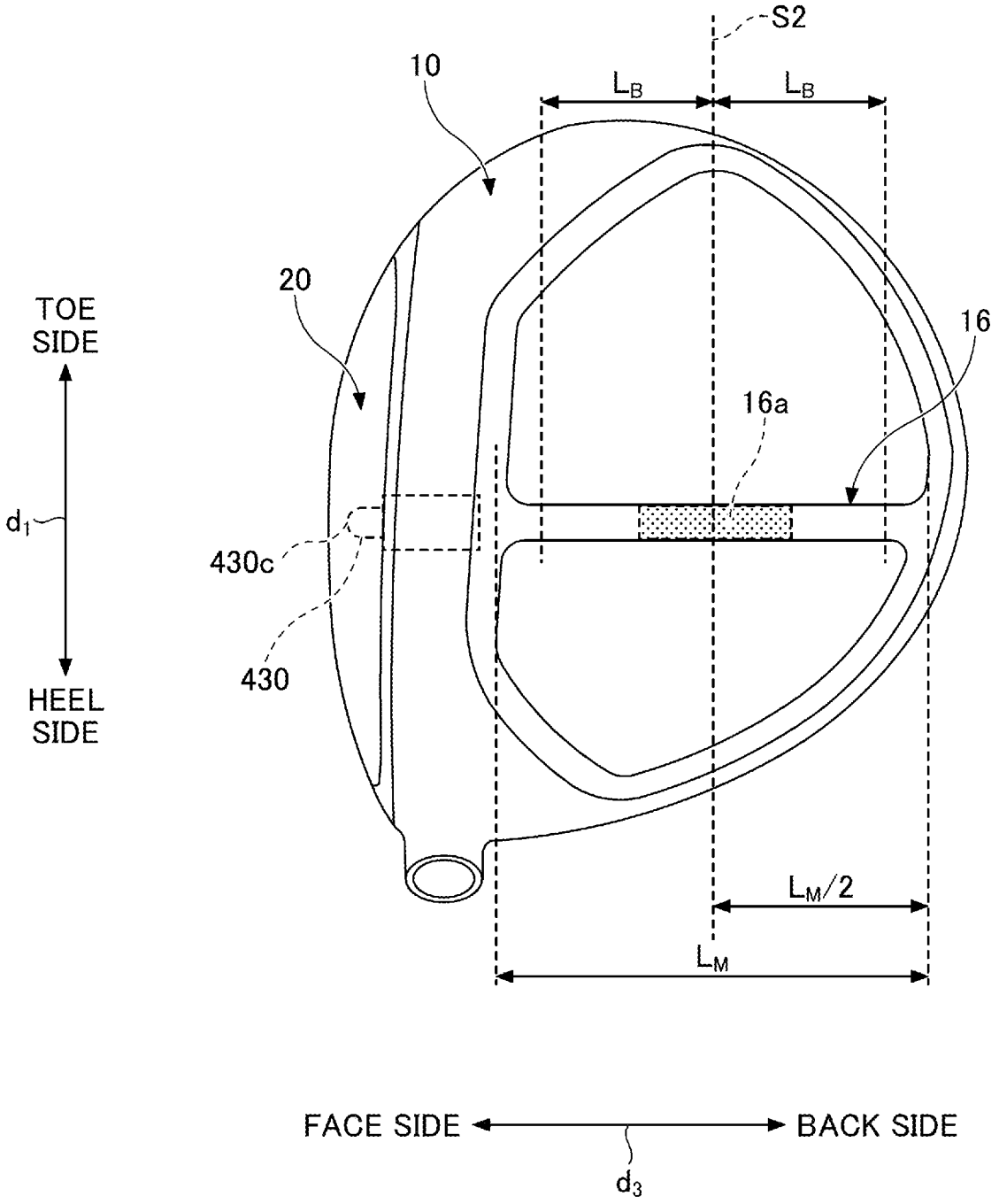
FIG. 7 is a top view (no. 2) illustrating an example of the golf club head according to the first embodiment of the present invention.

The thin portion 16*a* will be described further with reference to FIG. 7. FIG. 7 is a top view (no. 2) illustrating an example of the golf club head 1 according to the first embodiment. FIG. 7 illustrates a state in which the crown portion 30 is not attached to the body portion 10.

In FIG. 7, $L_M$ denotes the length between the face side end and the back side end of the beam portion 16 in the face-back direction, that is, the length of the beam portion 16 in the face-back direction. The notation of $L_M/2$ denotes half the length of the beam portion 16 in the face-back direction. Further, S2 denotes an imaginary straight line extending in the toe-heel direction through the center of the beam portion 16 in the face-back direction.

As viewed in the crown-sole direction, the thin portion 16*a* is preferably disposed in the face-back direction within the $L_B$ range of the length $L_M$ of the beam portion 16 in the face-back direction from the imaginary straight line S2. Here, $L_B$ is 40%. That is, $L_B=0.4\times L_M$.

As described above, by arranging the thin portion 16*a* in the face-back direction within the 40% range of the length $L_M$ of the beam portion 16 in the face-back direction from the imaginary straight line S2, it is possible to prevent the decrease in rigidity of the golf club head 1 due to providing the crown opening portion 14 and to secure surplus weight.

In the beam portion 16, the thickness of the thin portion 16*a* is preferably greater than or equal to 20% and less than or equal to 70% of the thickness other than the thin portion 16*a*. By setting the thickness of the thin portion 16*a* to such a range, the reduction in the rigidity of the golf club head 1 due to providing the crown opening portion 14 can be prevented and surplus weight can be secured. When the thickness of the thin portion 16*a* and/or the thickness of parts other than the thin portion 16*a* are not constant, the respective average thicknesses shall be compared.

Although the preferred embodiments have been described in detail above, the embodiments are not limited to the above-described embodiments, and various modifications and substitutions can be made to the above-described embodiments without departing from the scope described in the claims.

What is claimed is:

1. A golf club head comprising:

a body portion;

a face portion; and a crown portion, wherein the body portion includes:

a crown opening portion;

a beam portion that divides the crown opening portion; and a sole portion, the face portion includes:

a front surface configured to strike a ball; and a back surface positioned on an opposite side of the front surface, the crown portion is attached to the body portion so as to close the crown opening portion, the sole portion has a butting structure that contacts the back surface of the face portion, and as viewed in a crown-sole direction, a length from a face toe end to a face heel end of the face portion in a toe-heel direction is set as a face length, and each of a toe edge and a heel edge of the beam portion and a contact portion between the butting structure and the back surface is arranged within a 15% range of the face length in the toe-heel direction from an imaginary straight line extending in a face-back direction and through a center of the face length, wherein the beam portion includes a thin portion that is recessed from a side facing the sole portion towards a side facing the crown portion, and as viewed in the crown-sole direction, the thin portion is arranged, in the face-back direction, within a 40% range of a length of the beam portion in the face-back direction, from an imaginary straight line extending in the toe-heel direction and through a center of the beam portion in the face-back direction.

2. The golf club head according to claim 1, wherein as viewed in the crown-sole direction, each of the toe edge and the heel edge of the beam portion and the contact portion is arranged within a 10% range of the face length in the toe-heel direction from the imaginary straight line extending in the face-back direction and through the center of the face length.

3. The golf club head according to claim 1, wherein as viewed in the crown-sole direction, the contact portion is arranged within a range sandwiched between imaginary straight lines extending from the toe edge and the heel edge of the beam portion.

4. The golf club head according to claim 1, wherein a width of the beam portion in the toe-heel direction is greater than a thickness of the beam portion in the crown-sole direction.

5. The golf club head according to claim 1, wherein the beam portion has a width in the toe-heel direction that is greater than or equal to 4 mm and less than or equal to 10 mm, a thickness in the crown-sole direction that is greater than or equal to 0.5 mm and less than or equal to 2 mm, and a length in the face-back direction that is greater than or equal to 60 mm and less than or equal to 90 mm.

6. The golf club head according to claim 1, wherein in the beam portion, a thickness of the thin portion is greater than or equal to 20% and less than or equal to 70% of a thickness of a portion of the beam portion other than the thin portion.

7. The golf club head according to claim 1, wherein the crown portion is attached by an adhesive to an entire surface of the beam portion facing the crown portion and to a crown attachment portion provided around the crown opening portion.

8. The golf club head according to claim 1, wherein the butting structure is fastened to the sole portion by screwing and bonding from an outer surface of the sole portion.

9. The golf club head according to claim 1, wherein the beam portion extends in an inclined manner with respect to the face-back direction as viewed in the crown-sole direction, and as viewed in the crown-sole direction, an imaginary straight line extending in the face-back direction and through the contact portion, extends between the toe edge and the heel edge of the beam portion.

* * * * *